US010961898B2

(12) United States Patent
Kaneko et al.

(10) Patent No.: US 10,961,898 B2
(45) Date of Patent: Mar. 30, 2021

(54) COOLING CONTROLLER AND CONTROL METHOD FOR COOLING DEVICE

(71) Applicants: TOYOTA JIDOSHA KABUSHIKI KAISHA, Toyota (JP); AISIN SEIKI KABUSHIKI KAISHA, Kariya (JP)

(72) Inventors: Rihito Kaneko, Miyoshi (JP); Noboru Takagi, Toyota (JP); Naoto Hisaminato, Toyota (JP); Mitsuru Yamaguchi, Ama (JP); Hirokazu Ando, Seto (JP); Masaaki Yamaguchi, Okazaki (JP); Takahiko Aoyagi, Anjo (JP); Hirotaka Watanabe, Anjo (JP)

(73) Assignees: TOYOTA JIDOSHA KABUSHIKI KAISHA, Toyota (JP); AISIN SEIKI KABUSHIKI KAISHA, Kariya (JP)

( * ) Notice: Subject to any disclaimer, the term of this patent is extended or adjusted under 35 U.S.C. 154(b) by 2 days.

(21) Appl. No.: 16/438,564

(22) Filed: Jun. 12, 2019

(65) Prior Publication Data

US 2019/0383202 A1 Dec. 19, 2019

(30) Foreign Application Priority Data

Jun. 19, 2018 (JP) ..... JP2018-115864

(51) Int. Cl.
*F01P 7/16* (2006.01)
*F01P 5/12* (2006.01)
(Continued)

(52) U.S. Cl.
CPC ..... *F01P 7/16* (2013.01); *F01P 3/20* (2013.01); *F01P 5/12* (2013.01); *F01P 2007/146* (2013.01); *F01P 2037/00* (2013.01)

(58) Field of Classification Search
CPC .. F01P 11/14; F01P 2007/146; F01P 2031/00; F01P 2037/00; F01P 3/20; F01P 5/12; F01P 7/16; F01P 7/165
See application file for complete search history.

(56) References Cited

U.S. PATENT DOCUMENTS 4,738,330 A 4/1988 Suzuki et al.
2013/0020513 A1 1/2013 Matsusaka et al.
(Continued)

FOREIGN PATENT DOCUMENTS

JP 1-227816 A 9/1989
JP 10-238891 9/1998
(Continued)

*Primary Examiner* — Hai H Huynh
*Assistant Examiner* — Diem T Tran
(74) *Attorney, Agent, or Firm* — Oblon, McClelland, Maier & Neustadt, L.L.P.

(57) ABSTRACT

A cooling device includes an inner passage, an outer passage, an engine-driven pump, an electromagnetic control valve, and a driving circuit that regulates current flowing through the electromagnetic control valve by activating and deactivating a switching element. A cooling controller for the cooling device includes a processing circuit configured to execute an operation process for operating, when the engine-driven pump is driven, the switching element by setting a duty cycle of an activation time to a switching cycle, which is a reciprocal of a switching frequency of the switching element, to be a larger value when a temperature of the internal combustion engine is low than when the temperature is high and a cycle varying process for setting a longer switching cycle when the temperature of the internal combustion engine is less than a preset temperature than when the temperature is greater than or equal to the preset temperature.

5 Claims, 4 Drawing Sheets

(51) Int. Cl.
*F01P 3/20* (2006.01)
*F01P 7/14* (2006.01)

(56) References Cited

U.S. PATENT DOCUMENTS

| | | | | |
|---|---|---|---|---|
| 2014/0007824 | A1* | 1/2014 | Hayashi | F01P 7/167 123/41.01 |
| 2015/0101789 | A1* | 4/2015 | Enomoto | B60L 50/16 165/202 |
| 2015/0107345 | A1* | 4/2015 | Sugimoto | F01P 11/16 73/114.68 |
| 2016/0109163 | A1* | 4/2016 | Enomoto | F25B 13/00 62/160 |
| 2017/0037771 | A1 | 2/2017 | Takagi et al. | |

FOREIGN PATENT DOCUMENTS

| | | |
|---|---|---|
| JP | 2000-027646 | 1/2000 |
| JP | 2017-031909 | 2/2017 |
| WO | WO 2011/132530 A2 | 10/2011 |

* cited by examiner

COOLING CONTROLLER AND CONTROL METHOD FOR COOLING DEVICE

BACKGROUND

1. Field

The following description relates to a cooling controller and a control method for a cooling device including an inner passage that circulates coolant in an internal combustion engine and an outer passage connected to the inner passage and located outside the internal combustion engine, in which the inner passage and the outer passage configure a loop.

2. Description of Related Art

Japanese Laid-Open Patent Publication No. 2017-31909 discloses an example of a cooling device including an electric pump that circulates coolant in the internal combustion engine. The internal combustion engine includes an inner passage that circulates coolant in the internal combustion engine, an outer passage connected to the inner passage, and an electromagnetic control valve. The inner passage and the outer passage configure a loop. The electromagnetic control valve is configured to adjust the cross-sectional flow area of the loop through electronic control. The flow of coolant applies force to the electromagnetic control valve acting in a valve-opening direction, in which the electromagnetic control valve opens. Thus, electromagnetic force needs to be produced in order to close the electromagnetic control valve when the internal combustion engine is running.

SUMMARY

The inventors attempted to expedite warm-up of the internal combustion engine after cold-starting the engine by closing the electromagnetic control valve to open the loop while circulating coolant in the internal combustion engine with an engine-driven pump. In this case, current flows through the coil of the electromagnetic control valve in order to keep the electromagnetic control valve closed. As a result, after the internal combustion engine is warmed up, the coil will be overheated.

It is an objective of the present disclosure to provide a cooling controller that reduces the amount of heat generated in a coil when the temperature of the internal combustion engine is high while sufficiently reducing the average value of the cross-sectional flow area of the outer passage with an electromagnetic control valve when the temperature of the internal combustion engine is low.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The examples of the present disclosure will now be described.

Example 1

A cooling controller adapted for use in a cooling device is provided. The cooling device includes an inner passage that circulates coolant in an internal combustion engine, an outer passage located outside the internal combustion engine and connected to the inner passage, the inner passage and the outer passage configuring a loop, an engine-driven pump configured to circulate the coolant in the loop when driven by rotational power of a crankshaft of the internal combustion engine, an electromagnetic control valve configured to adjust a cross-sectional flow area of the outer passage, the electromagnetic control valve being open in a non-energized state when the engine-driven pump is driven, and a driving circuit configured to regulate current flowing through the electromagnetic control valve by activating and deactivating a switching element. The cooling controller includes a processing circuit configured to execute an operation process for operating, when the engine-driven pump is driven, the switching element by setting a duty cycle of an activation time to a switching cycle, which is a reciprocal of a switching frequency of the switching element, to be a larger value in a case in which a temperature of the internal combustion engine is low than in a case in which the temperature of the internal combustion engine is high. The processing circuit is also configured to execute a cycle varying process for setting the switching cycle to be longer when the temperature of the internal combustion engine is less than a preset temperature than when the temperature of the internal combustion engine is greater than or equal to the preset temperature.

Even if the duty cycle is the same, the activation time is longer when the switching cycle is long than when the switching cycle is short. Since current flowing through the coil of the electromagnetic control valve is larger when the activation time is long than when the activation time is short, the force that closes the electromagnetic control valve is strong. Thus, when the outlet temperature is less than the preset temperature, it is desired that the switching cycle be lengthened to set a sufficiently small average value of the cross-sectional flow area of the outer passage by the electromagnetic control valve. However, in this case, when the temperature of the internal combustion engine is high, the temperature of the surroundings of the coil is high. This limits expedition of the heat dissipation of the coil and thus may overheat the coil. In the above-described configuration, a longer switching cycle is set when the outlet temperature is less than the preset temperature than when the outlet temperature is greater than or equal to the preset temperature. This limits the amount of heat generated by the coil when the temperature of the internal combustion engine is high while setting a sufficiently small average value of the cross-sectional flow area of the outer passage by the electromagnetic control valve when the temperature of the internal combustion engine is low.

Example 2

In the cooling controller according to example 1, a period longer than the switching cycle set through the cycle varying process when the temperature of the internal combustion engine is less than the preset temperature is referred to as a predetermined period. The switching cycle set through the cycle varying process when the temperature of the internal combustion engine is greater than or equal to the preset temperature is referred to as a first switching cycle. The switching cycle set through the cycle varying process when the temperature of the internal combustion engine is less than the preset temperature is referred to as a second switching cycle. The duty cycle is set such that a duty cycle that keeps the electromagnetic control valve closed over the predetermined period during the second switching cycle cannot keep the electromagnetic control valve closed over the predetermined period during the first switching cycle.

In the above-described configuration, as compared to when the duty cycle is set to keep the electromagnetic control valve closed over the predetermined period using the switching cycle, which is set through the cycle varying process in a case in which the outlet temperature is greater than or equal to the preset temperature, the first switching cycle can be shortened when the outlet temperature is greater than or equal to the preset temperature. This reduces the amount of heat generated by the coil.

Example 3

In the cooling controller according to example 1 or 2, the cooling device further includes a radiator passage connected to the inner passage, the radiator passage being separate from the outer passage and connected to the radiator, and a thermostat configured to connect and disconnect the inner passage to and from the radiator. The thermostat is configured to allow the inner passage and the radiator to be connected to each other when the temperature of the internal combustion engine is greater than or equal to a predetermined temperature. The preset temperature is lower than the predetermined temperature.

When the thermostat opens, the temperature of the internal combustion engine is high. Thus, when the switching cycle is lengthened until the thermostat opens, the coil may be overheated. In the configuration of Example 3, the switching cycle is switched before the thermostat opens. Thus, as compared to when the switching cycle is switched after the thermostat opens, overheating of the coil is limited.

Example 4

In the cooling controller according to any one of examples 1 to 3, the operation process includes a process for setting, when the temperature of the internal combustion engine is less than the preset temperature, the duty cycle to be smaller in a case in which a large amount of fuel is supplied into a combustion chamber of the internal combustion engine per unit of time than in a case in which a small amount of fuel is supplied.

In a case in which circulation of coolant in the inner passage is excessively restricted even when the temperature of the internal combustion engine is low, coolant may boil in the inner passage, where the small cross-sectional flow area is small, such as in a drilled passage. In the configuration of Example 4, when the amount of fuel is large and the amount of heat generated in the internal combustion engine is large, the duty cycle is shortened, thereby setting a large average value of the cross-sectional flow area of the outer passage, which is adjusted by the electromagnetic control valve. This increases the circulation amount of coolant and thus limits an excessive increase in the temperature of the inner passage on a local level.

Example 5

A control method for a cooling device is provided. The cooling device including an inner passage that circulates coolant in an internal combustion engine, an outer passage located outside the internal combustion engine and connected to the inner passage, the inner passage and the outer passage configuring a loop, an engine-driven pump configured to circulate the coolant in the loop when driven by rotational power of a crankshaft of the internal combustion engine, an electromagnetic control valve configured to adjust a cross-sectional flow area of the outer passage, the electromagnetic control valve being open in a non-energized state when the engine-driven pump is driven, and a driving circuit configured to regulate current flowing through the electromagnetic control valve by activating and deactivating a switching element. The control method includes operating, when the engine-driven pump is driven, the switching element by setting a duty cycle of an activation time to a switching cycle, which is a reciprocal of a switching frequency of the switching element, to be a larger value in a case in which a temperature of the internal combustion engine is low than in a case in which the temperature of the internal combustion engine is high. The control method also includes setting the switching cycle to be longer when the temperature of the internal combustion engine is less than a preset temperature than when the temperature of the internal combustion engine is greater than or equal to the preset temperature.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A cooling controller and a control method for a cooling device according to an embodiment will now be described with reference to the drawings.

Figure 1:
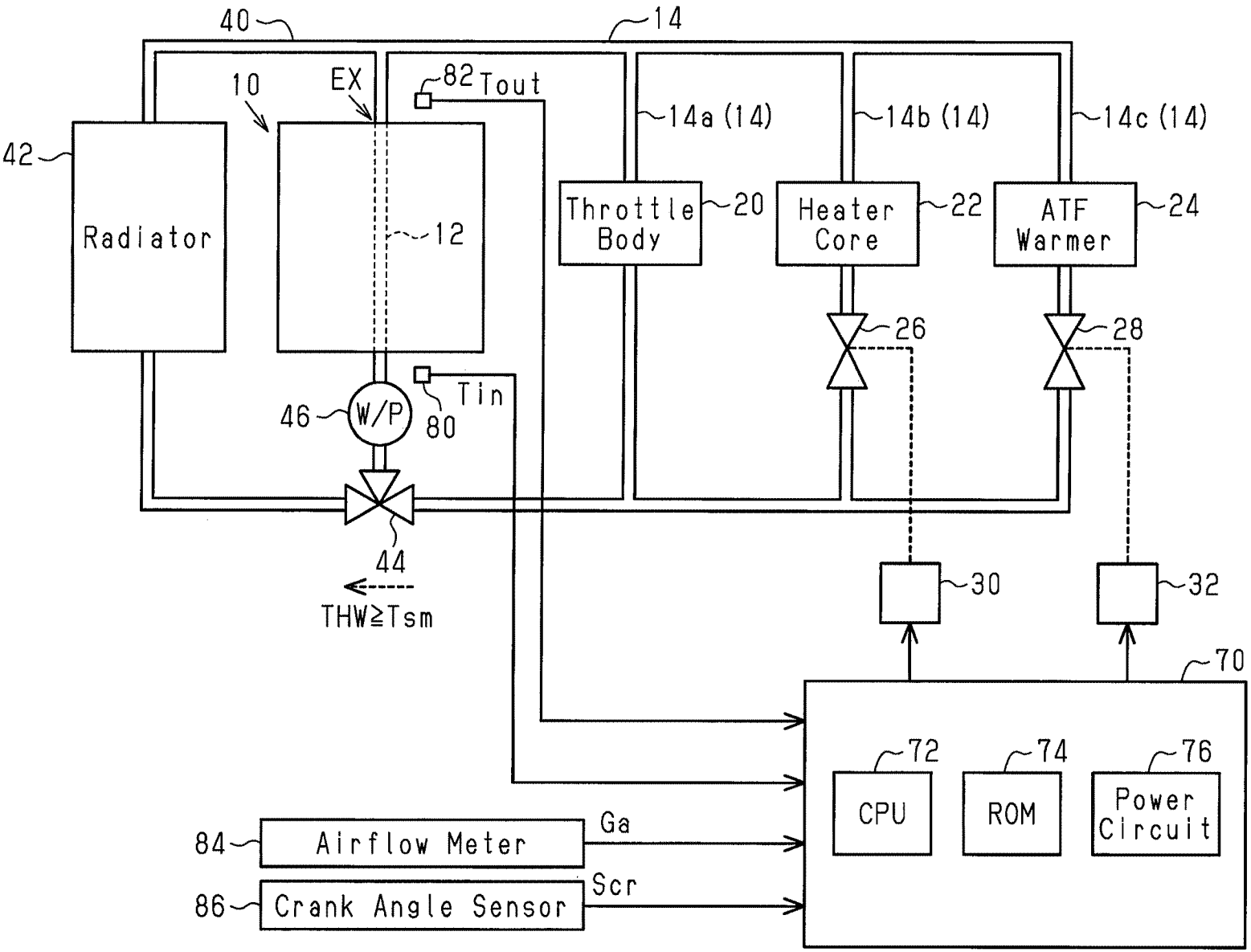
FIG. 1 is a diagram showing a cooling controller and a cooling device according to an embodiment.

FIG. 1 shows a spark-ignition internal combustion engine 10. The internal combustion engine 10 includes an inner passage 12 that circulates coolant in the internal combustion engine 10. The inner passage 12 is connected to an outer passage 14 located outside the internal combustion engine 10. The inner passage 12 and the outer passage 14 configure a loop. The outer passage 14 branches into a throttle passage 14*a*, a heater core passage 14*b*, and a warmer passage 14*c*. The throttle passage 14*a* includes a throttle body 20 serving as a passage where the temperature of the throttle valve is adjusted with coolant. The heater core passage 14*b* includes a heater core 22, which is a heat exchanger. In the heater core 22, the heat of coolant in the internal combustion engine 10 is applied to air supplied into the passenger compartment. The heater core passage 14*b* includes an electromagnetic control valve 26 on the downstream side of the heater core 22. The electromagnetic control valve 26 adjusts the cross-sectional flow area of the heater core passage 14*b*. The warmer passage 14*c* includes an automatic transmission fluid (ATF) warmer 24, which is a heat exchanger. The ATF warmer 24 is configured to adjust the temperature of an ATF, which is hydraulic oil for an automatic transmission, with the heat of coolant. The warmer passage 14*c* includes an electromagnetic control valve 28 on the downstream side of the ATF warmer 24. The electromagnetic control valve 28 adjusts the cross-sectional flow area of the warmer passage 14*c*.

The electromagnetic control valve 26 is driven by a driving circuit 30. The electromagnetic control valve 28 is driven by a driving circuit 32.

The inner passage 12 is further connected to a radiator passage 40. The loop is also configured by the inner passage 12 and the radiator passage 40. The radiator passage 40 is connected to a radiator 42 that exchanges heat with the surrounding air to dissipate the heat of the coolant in the internal combustion engine 10.

The downstream sides of the throttle passage 14*a*, the heater core passage 14*b*, and the warmer passage 14*c* merge with one another and connect to the inner passage 12 via a thermostat 44 and an engine-driven pump 46. The downstream side of the radiator passage 40 is also connected to the inner passage 12 via the thermostat 44 and the engine-driven pump 46.

The thermostat 44 is a three-way valve that guides the downstream sides of the outer passage 14 and the radiator passage 40 to the inner passage 12. The thermostat 44 accommodates wax. When the wax expands in accordance with the temperature of coolant in the vicinity of the thermostat 44, the state of the valve changes. More specifically, when the temperature of coolant (water temperature THW) is less than a predetermined temperature Tsm (for example, greater than or equal to 90° C.), the cross-sectional flow area of the path through which coolant flows from the radiator passage 40 to the inner passage 12 is set to zero by the thermostat 44, and the cross-sectional flow area of the path through which coolant flows from the outer passage 14 to the inner passage 12 is set to be larger than zero by the thermostat 44. Further, when the water temperature THW is greater than or equal to the predetermined temperature Tsm, the cross-sectional flow area of the path through which coolant flows from the radiator passage 40 to the inner passage 12 and the cross-sectional flow area of the path through which coolant flows from the outer passage 14 to the inner passage 12 are both set to be larger than zero by the thermostat 44.

The engine-driven pump 46 is driven by the rotational power of the crankshaft of the internal combustion engine 10. The engine-driven pump 46 is an engine-driven water pump that causes coolant drawn in from the suction port to be discharged out of the discharge port. The engine-driven pump 46 rotates in synchronization with rotation of the crankshaft. Thus, the discharge amount per unit of time is larger when the rotational speed of the crankshaft is high than when the rotational speed of the crankshaft is low.

The cooling device of the internal combustion engine 10 is configured by the inner passage 12, the outer passage 14, the throttle body 20, the heater core 22, the ATF warmer 24, the electromagnetic control valves 26 and 28, the driving circuits 30 and 32, the radiator passage 40, the radiator 42, the thermostat 44, and the engine-driven pump 46.

Figure 2:
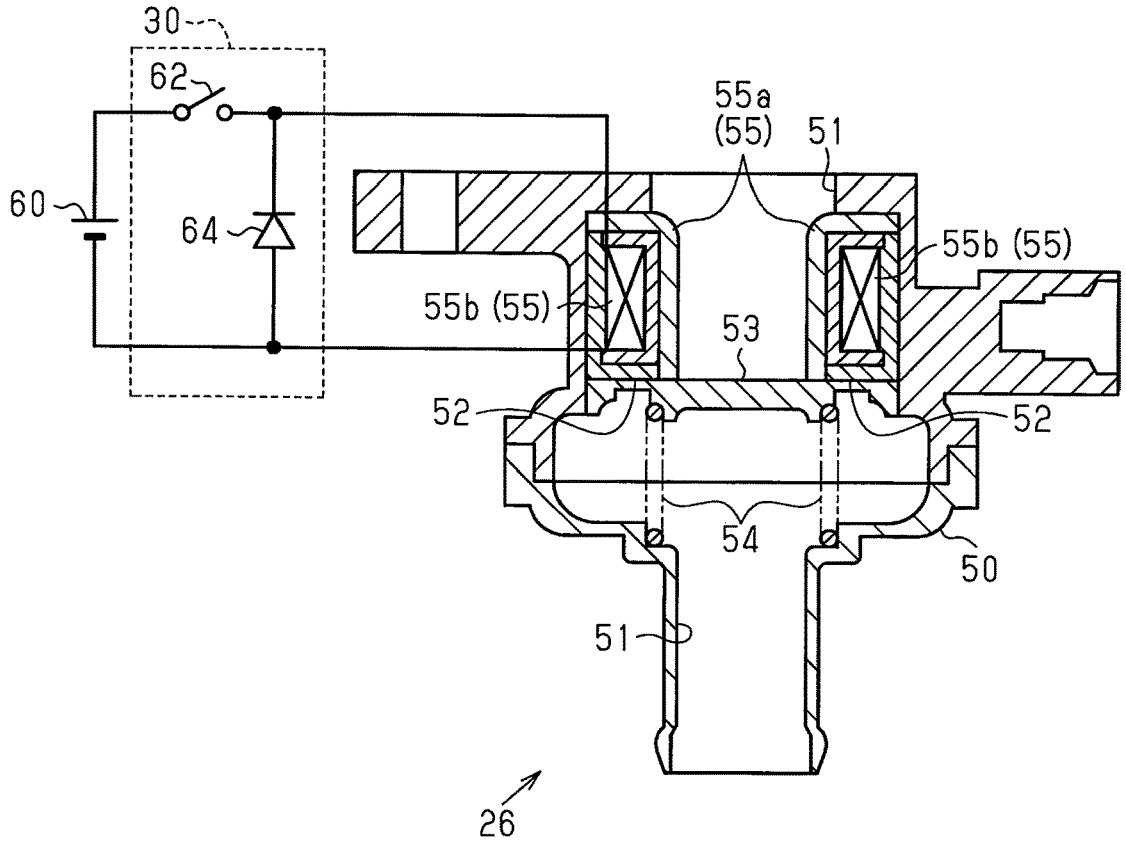
FIG. 2 is a diagram showing the electromagnetic control valve and the driving circuit in the cooling device of FIG. 1.

FIG. 2 shows the structures of the electromagnetic control valve 26 and the driving circuit 30. The electromagnetic control valve 28 and the driving circuit 32 have the same structures and thus will not be described.

As shown in FIG. 2, the electromagnetic control valve 26 includes a housing 50. The housing 50 includes a coolant passage 51 through which coolant passes. The coolant passage 51 includes a valve seat 52 and a valve body 53.

The housing 50 accommodates a coil spring 54 that constantly produces elastic force in a direction in which the valve body 53 moves toward the valve seat 52 (valve-closing direction, i.e., upward direction in FIG. 2). The housing 50 also includes an electromagnet 55. The electromagnet 55 includes a core 55*a* made of a soft magnetic material and a coil 55*b* shaped to surround the core 55*a*.

The coil 55*b* is connected to the driving circuit 30. The driving circuit 30 includes a switching element 62. The switching element 62 is activated and deactivated to open and close a loop configured by the switching element 62, the coil 55*b*, and a battery 60. Further, the driving circuit 30 includes a diode 64 of which the cathode is connected to the positive electrode terminal of the battery 60. The diode 64 and the coil 55*b* configure a closed loop.

When the switching element 62 is activated, the loop configured by the battery 60, the switching element 62, and the coil 55*b* is closed. This gradually increases current flowing through the coil 55*b*. When the switching element 62 is deactivated, current flows through the coil 55*b* via the loop configured by the diode 64 and the coil 55*b*. This gradually decreases the amount of the current. When current flows through the coil 55*b*, the electromagnet 55 produces magnetic force that attracts the valve body 53 in the valve-closing direction.

Figure 3A:
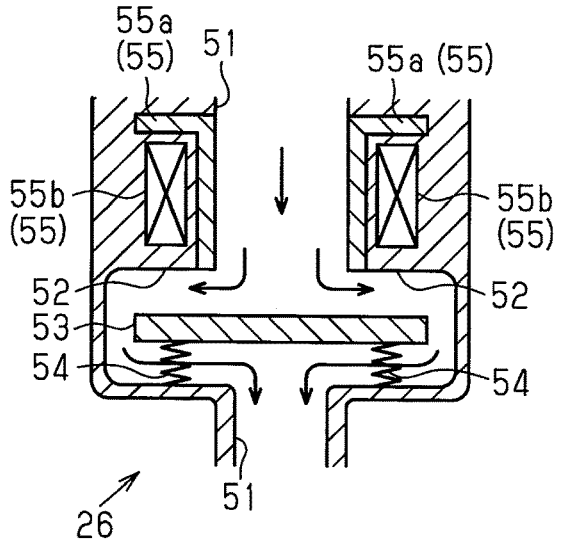
FIG. 3A is a diagram showing the electromagnetic control valve of FIG. 2 when open.

The electromagnetic control valve 26 is coupled to the heater core passage 14*b* so that coolant flows in a direction opposite to the direction in which the coil spring 54 applies elastic force to the valve body 53 in the coolant passage 51. When the engine-driven pump 46 is driven, coolant produces pressure acting in a direction in which the valve body 53 moves away from the valve seat 52 (valve-opening direction, i.e., downward direction in FIG. 2). Thus, when the coil 55*b* is not energized, the electromagnetic control valve 26 opens as shown in FIG. 3A.

Figure 3B:
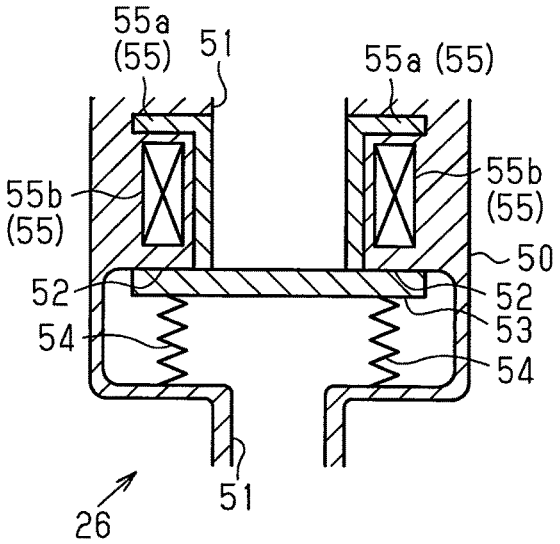
FIG. 3B is a diagram showing the electromagnetic control valve of FIG. 2 when closed.

When the coil 55*b* is energized, the electromagnet 55 produces magnetic force that attracts the valve body 53 in the valve-closing direction. Thus, as shown in FIG. 3B, the elastic force of the coil spring 54 and the attraction force of the electromagnet 55 hold the valve body 53 on the valve seat 52 against the pressure of coolant flowing into the coolant passage 51. That is, the electromagnetic control valve 26 closes.

FIG. 1 shows a controller 70 that controls the cooling device by operating the electromagnetic control valves 26 and 28. In addition, the controller 70 controls torque or exhaust component, which is the control amount of the internal combustion engine 10. The controller 70 executes an air-fuel ratio control as control of the exhaust component.

The air-fuel ratio control is to set the amount of fuel injected in accordance with the amount of fresh air filling the combustion chamber.

In order to control the control amount, the controller 70 refers to an inlet temperature Tin, an outlet temperature Tout, an intake air amount Ga, and an output signal Scr of a crank angle sensor 86. The inlet temperature Tin is the temperature of coolant on the inlet side of the inner passage 12 detected by an inlet temperature sensor 80. The outlet temperature Tout is the temperature of coolant on the outlet side of the inner passage 12 detected by an outlet temperature sensor 82. The intake air amount Ga is detected by an airflow meter 84. The controller 70 includes a CPU 72, a ROM 74, and a power circuit 76 that supplies power to elements in the controller 70. The controller 70 controls the above-described control amount by executing a program stored in the ROM 74 with the CPU 72.

Figure 4:
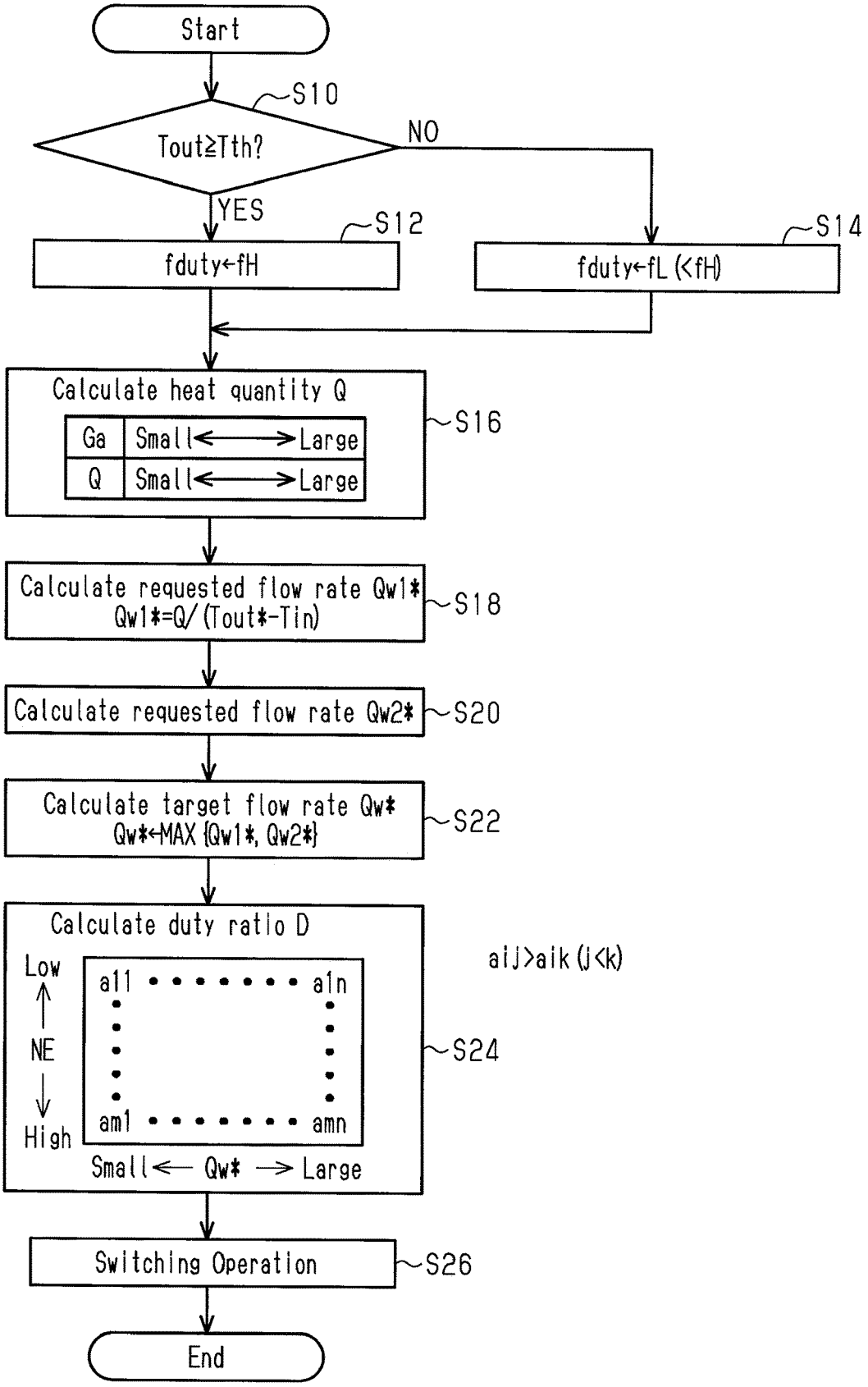
FIG. 4 is a flowchart illustrating a procedure for processes executed by the cooling controller shown in FIG. 1.

FIG. 4 shows a procedure for processes of operating the electromagnetic control valve 26 among the processes executed by the controller 70. The processes illustrated in FIG. 4 are implemented when the CPU 72 repeatedly executes the program stored in the ROM 74, for example, in a predetermined cycle. In the following description, the step number of each process is represented by a number in front of which the character S is given.

In a series of processes shown in FIG. 4, the CPU 72 first determines whether the outlet temperature Tout is greater than or equal to a preset temperature Tth (S10). This process is to determine whether expediting warm-up of the internal combustion engine 10 is required. The preset temperature Tth is lower than the predetermined temperature Tsm (for example, 60° C. to 80° C.). When determining that the outlet temperature Tout is greater than or equal to the preset temperature Tth (S10: YES), the CPU 72 substitutes a normal frequency fH into a switching frequency fduty, which is the reciprocal of a switching cycle (PWM cycle) during which the switching element 62 is activated and deactivated (S12). When determining that the outlet temperature Tout is less than the preset temperature Tth (S10: NO), the CPU 72 substitutes a low-temperature frequency fL into the switching frequency fduty (S14). The low-temperature frequency fL is lower than the normal frequency fH.

When completing the process of S12 or S14, the CPU 72 calculates a heat quantity Q generated per unit of time in the combustion chamber of the internal combustion engine 10 based on the intake air amount Ga (S16). The CPU 72 calculates the heat quantity Q to be a larger value when the intake air amount Ga is large than when the intake air amount Ga is small. The intake air amount Ga is a parameter correlated with the amount of fresh air filling the combustion chamber per unit of time. More specifically, the ROM 74 already stores map data in which the intake air amount Ga is an input variable and the heat quantity Q is an output variable, and the CPU 72 uses this map data to calculate the heat quantity Q.

Map data refers to a set of data including the discrete values of input invariables and the values of output variables that respectively correspond to the values of the input variables. In the calculation using this data map, i.e., in map calculation, for example, when the value of an input variable coincides with any one of the input variables of a map data, the value of the corresponding output variable of the map data is treated as a calculation result. Further, when such a coincidence does not occur, a value obtained through interpolation of the output variables included in the map data is treated as a calculation result.

Subsequently, the CPU 72 calculates a requested flow rate Qw1*, which is the flow rate of coolant flowing through the electromagnetic control valve 26. The requested flow rate Qw1* is requested to control the outlet temperature Tout to a target outlet temperature Tout* (S18). The CPU 72 calculates the requested flow rate Qw1* to be a larger value when the heat quantity Q is large than when the heat quantity Q is small. Further, the CPU 72 calculates the requested flow rate Qw1* to be a smaller value when the target outlet temperature Tout* exceeds the inlet temperature Tin to a large extent than when the target outlet temperature Tout* exceeds the inlet temperature Tin to a small extent. More specifically, the following equation is used to calculate the requested flow rate Qw1*. The target outlet temperature Tout* is higher than the preset temperature Tth.

$$Qw1^*=Q/(Tout^*-Tin)$$

When the value of the right-hand side of the equation is less than or equal to a preset value, the CPU 72 sets the requested flow rate Qw1* to zero. Even if the outlet temperature Tout is less than the preset temperature Tth, the value of the right-hand side of the equation is greater than the preset value when the intake air amount Ga is large. This is because even if the outlet temperature Tout is less than the preset temperature Tth, the internal combustion engine 10 generates a large amount of heat per unit of time when the intake air amount Ga is large. Thus, when the electromagnetic control valve 26 is kept closed, coolant may boil in the inner passage 12, where the small cross-sectional flow area is small, such as in a drilled passage. In order to prevent such boiling, even if the outlet temperature Tout is less than the preset temperature Tth, the CPU 72 calculates the requested flow rate Qw1* to a value larger than zero when the intake air amount Ga is large.

Further, the CPU 72 calculates a requested flow rate Qw2* in accordance with a request for heating a vehicle (S20). The CPU 72 calculates the requested flow rate Qw2* to a larger value when the heating request is large than when the heating request is small (S20).

Then, the CPU 72 substitutes the larger one of the requested flow rate Qw1* and the requested flow rate Qw2* into a requested flow rate Qw* (S22). Subsequently, the CPU 72 calculates a duty cycle D of the switching element 62, which is used to control the flow rate of coolant flowing through the electromagnetic control valve 26 to the requested flow rate Qw* (S24). The duty cycle D is the ratio of the activation time to the switching cycle. The CPU 72 calculates the duty cycle D to a larger value in order to set a longer period during which the electromagnetic control valve 26 closes when the requested flow rate Qw1* is small than when the requested flow rate Qw1* is large. In addition, the CPU 72 calculates the duty cycle D to a larger value when a rotational speed NE is high than when the rotational speed NE is low. This calculation is performed for the following reason. The amount of water discharged by the engine-driven pump 46 per unit of time is larger when the rotational speed NE is high than when the rotational speed NE is low, thereby increasing the force by coolant to open the valve body 53. The rotational speed NE is calculated by the CPU 72 based on the output signal Scr.

In detail, the ROM 74 already stores map data in which the requested flow rate Qw* and the rotational speed NE are input variables and the duty cycle D is an output variable, and the CPU 72 uses this map data to calculate the duty cycle D. An output variable aij (i=1 to m, j=1 to n) of the map data is demonstrated in FIG. 4. A variable i specifies a value of the rotational speed NE, and a variable j specifies a value of the requested flow rate Qw*. FIG. 4 shows that j is less than k, i.e., the output variable aij when the requested flow rate Qw* is small is larger than an output variable aik when the requested flow rate Qw* is large.

The CPU 72 activates and deactivates the switching element 62 in accordance with the duty cycle D (S26).

When completing the process of S26, the CPU 72 ends the series of processes shown in FIG. 4.

The processes for operating the switching element of the electromagnetic control valve 28 are performed in the same manner as the processes shown in FIG. 4. In the process of S20, the requested flow rate Qw2* is calculated in accordance with a request of the heat quantity of the ATF warmer 24 instead of the heating request of the vehicle.

The operation of the present embodiment will now be described.

Figure 5A:
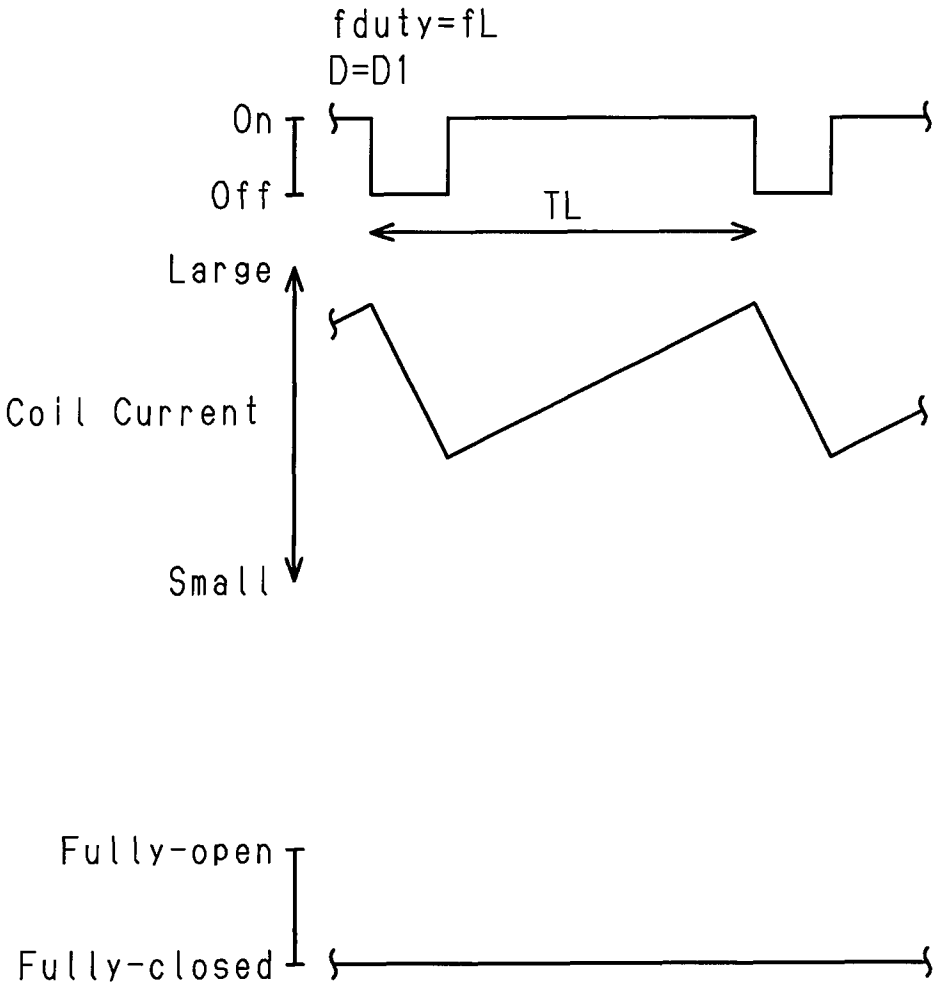
FIG. 5A is a time chart illustrating an effect of the cooling controller shown in FIG. 1.
Figure 5B:
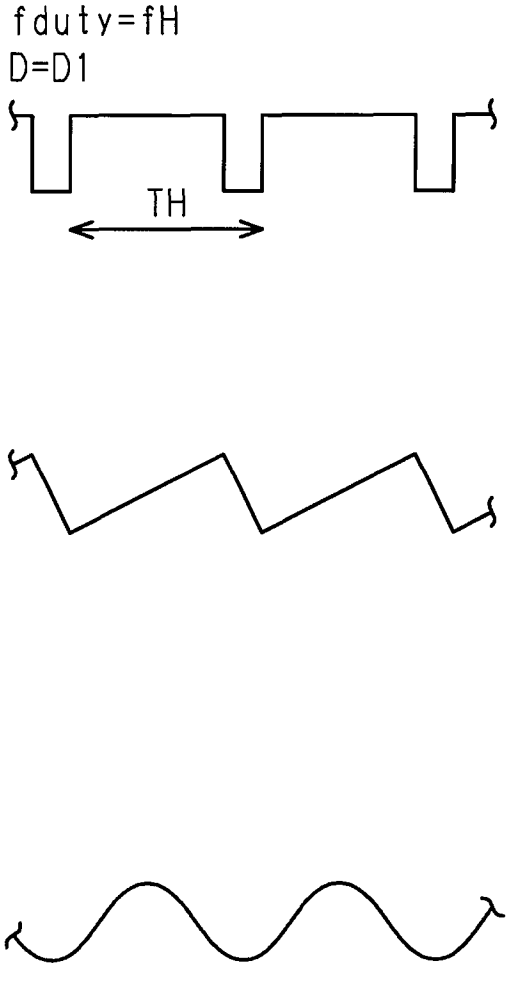
FIG. 5B is a time chart illustrating an effect of the cooling controller shown in FIG. 1.

FIG. 5A shows a case in which the outlet temperature Tout is less than the preset temperature Tth, and FIG. 5B shows a case in which the outlet temperature Tout is greater than or equal to the preset temperature Tth.

As shown in FIG. 5A, when the outlet temperature Tout is less than the preset temperature Tth, the CPU 72 sets the switching frequency to the low-temperature frequency fL and operates the switching element 62. The duty cycle D1 is a value (for example, 80%) that keeps the electromagnetic control valve 26 closed when the switching frequency is the low-temperature frequency fL. When the CPU 72 activates the switching element 62, the amount of current flowing through the coil 55*b* gradually increases. Subsequently, when the CPU 72 deactivates the switching element 62, the amount of current flowing through the coil 55*b* gradually decreases. As shown in FIGS. 5A and 5B, when the duty cycle D is large to some extent, the switching element 62 becomes activated before the amount of current flowing through the coil 55*b* becomes zero. Thus, current needs to continuously flow through the coil 55*b*.

A larger amount of current flows through the coil 55*b* when the switching element 62 is activated for a long period of time than when the switching element 62 is activated for a short period of time. The electromagnet 55 produces a larger electromagnetic force that attracts the valve body 53 in the valve-closing direction when a large amount of current flows through the coil 55*b* than when a small amount of current flows through the coil 55*b*. As shown in FIGS. 5A and 5B, when the switching element 62 is activated and deactivated, the amount of current flowing through the coil 55*b* gradually increases and decreases in a repeated manner. Thus, the minimum value of current flowing through the coil 55*b* is larger when the maximum value of current flowing through the coil 55*b* is large than when the maximum value of current flowing through the coil 55*b* is small. This lengthens the period during which the electromagnetic control valve 26 can be closed.

Accordingly, in the present embodiment, when the temperature of the internal combustion engine 10 is low, that is, when warm-up of the internal combustion engine 10 requires to be expedited, the time during which activation is performed is further lengthened even in the same duty cycle by reducing the switching frequency fduty to the low-temperature frequency fL. This allows the valve-closing period of the electromagnetic control valve 26 to be easily obtained. In a case in which the duty cycle D1 is employed, the electromagnetic control valve 26 can be continuously closed for a period longer than a switching cycle TL, during which the outlet temperature Tout is less than the preset temperature Tth. This sufficiently limits the emission of heat generated in the internal combustion engine 10 to, for example, the heater core 22 or the ATF warmer 24.

In the present embodiment, as shown in FIG. 5B, when the outlet temperature Tout is greater than or equal to the preset temperature Tth, the switching frequency fduty is set to the normal frequency fH. Since the normal frequency fH is higher than the low-temperature frequency fL, the activation time of the switching element 62 is shortened even in the same duty cycle. Consequently, the maximum value of current flowing through the coil 55*b* is small. The amount of heat generated in the coil 55*b* is proportional to the square of the amount of current flowing through the coil 55*b*. Thus, when the outlet temperature Tout is greater than or equal to the preset temperature Tth, the amount of heat generated in the coil 55*b* is reduced by setting the switching frequency fduty to the normal frequency fH. When the outlet temperature Tout is greater than or equal to the preset temperature Tth, the temperature of the electromagnetic control valve 26 tends to be high. Thus, when the amount of heat generated in the coil 55*b* is excessively large, wearing of the electromagnetic control valve 26 becomes noticeable. This may lower the durability. When the outlet temperature Tout is greater than or equal to the preset temperature Tth, there is no issue for keeping the electromagnetic control valve 26 closed. Further, a request is issued for setting a relatively large average open degree, which is achieved by repeatedly opening and closing the electromagnetic control valve 26. This prevents decreases in the controllability of the flow rate that occur when the switching frequency fduty is set to the normal frequency fH.

Accordingly, in the present embodiment, setting the switching frequency fduty to the normal frequency fH when the outlet temperature Tout is greater than or equal to the preset temperature Tth prevents excessive increases in the temperature of the electromagnetic control valve 26 while preventing decreases in the controllability for the requested flow rate Qw*.

In the present embodiment, as shown in FIG. 5B, when the switching frequency fduty is set to the normal frequency fH, the duty cycle D1 does not keep the electromagnetic control valve 26 closed. Thus, as compared to when the duty cycle D1 keeps the electromagnetic control valve 26 closed, the maximum value of current flowing through the coil 55*b* is set to a minimum value. Consequently, the amount of heat generated in the coil 55*b* is further reduced.

It is assumed in FIGS. 5A and 5B that the rotational speed NE is greater than or equal to a target rotation speed during idling and less than or equal to a preset rotation speed (for example, 3000 rpm).

Correspondence

The correspondence between the matters in the above-described embodiment and the matters described in the section SUMMARY is as follows. Hereinafter, the correspondence relationship is shown for every number in the example described in the section SUMMARY. [1] The operation process corresponds to the processes of S16 to S26. In the process of S18, when the inlet temperature Tin is low, the requested flow rate Qw1* is small. Consequently, when the process of S24 is performed, the duty cycle D has a large value. The frequency varying process corresponds to the processes of S10 to S14. [2] The "duty cycle, which keeps the electromagnetic control valve closed" corresponds to the duty cycle D1 shown in FIG. 5. [4] The configuration of Example 4 corresponds to the process of S24.

Modifications

The above-described embodiments may be modified as described below. The above-described embodiments and the following modifications may be implemented in combination with each other as long as technical contradiction does not occur.

Operation Process

The requested flow rate Qw1* does not have to be inversely proportional to the difference between the target outlet temperature Tout* and the inlet temperature Tin. Instead, for example, the base value of the flow rate proportional to the heat quantity Q may be corrected with an operation amount for performing feedback control for the outlet temperature Tout to the target outlet temperature Tout*.

In the above-described embodiment, the heat quantity Q is calculated based on the intake air amount Ga. Instead, for example, the heat quantity Q may be calculated based on the injection amount per unit of time.

Cycle Varying Process

In the above-described embodiment, when the outlet temperature Tout is less than the preset temperature Tth, the low-temperature frequency fL is used. Instead, for example, when the inlet temperature Tin is less than the preset temperature Tth, the low-temperature frequency ft may be used. Alternatively, instead of using the inlet temperature Tin and the outlet temperature Tout, for example, a sensor that detects the temperature of the inner passage 12 may be employed. In this case, when the detection value is less than the preset temperature Tth, the low-temperature frequency fL may be used.

Additionally, for example, in order to prevent the occurrence of hunting of switching between the low-temperature frequency fL and the normal frequency fH, a first preset temperature TthH and a second preset temperature TthL may be used to perform switching between the low-temperature frequency fL and the normal frequency fH. The second preset temperature TthL is lower than the first preset temperature TthH. More specifically, the switching frequency fduty simply needs to be switched to the normal frequency fH when the water temperature reaches the first preset temperature TthH, and the switching frequency fduty simply needs to be switched from the normal frequency fH to the low-temperature frequency fL when the water temperature becomes less than the second preset temperature TthL.

Thermostat

In the above-described embodiment, the thermostat 44, which is mechanical, is used to open the electromagnetic control valve 26 with the melting point of wax. Instead, for example, a device capable of performing opening/closing control through electronic operation may be used. Even in this case, in order to dissipate the heat of coolant using the radiator 42, it is desired that the preset temperature Tth be lower than the predetermined temperature Tsm, at which the thermostat 44 opens.

Electromagnetic Control Valve

In the above-described embodiment, the electromagnetic control valve 26 includes the coil spring 54, which produces elastic force acting in the valve-closing direction. Instead, for example, the electromagnetic control valve 26 may include a coil spring that produces elastic force acting in the valve-opening direction. In this case, even when the internal combustion engine 10 is not running, the electromagnetic control valve 26 is open as long as electromagnetic force acts.

Cooling Controller

The cooling controller does not have to include the CPU 72 and the ROM 74 to execute software processing. For example, at least part of the processes executed by the software in the above-described embodiment may be executed by hardware circuits dedicated to executing these processes (such as ASIC). That is, the cooling controller may be modified as long as it has any one of the following configurations (a) to (c): (a) A configuration including a processor that executes all of the above-described processes according to programs and a program storage device such as a ROM that stores the programs; (b) A configuration including a processor and a program storage device that execute part of the above-described processes according to the programs and a dedicated hardware circuit that executes the remaining processes; and (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A cooling controller adapted for use in a cooling device, the cooling device including an inner passage that circulates coolant in an internal combustion engine, an outer passage located outside the internal combustion engine and connected to the inner passage, the inner passage and the outer passage configuring a loop, an engine-driven pump configured to circulate the coolant in the loop when driven by rotational power of a crankshaft of the internal combustion engine, an electromagnetic control valve configured to adjust a cross-sectional flow area of the outer passage, the electromagnetic control valve being open in a non-energized state when the engine-driven pump is driven, and a driving circuit configured to regulate current flowing through the electromagnetic control valve by activating and deactivating a switching element, wherein the cooling controller comprises a processing circuit configured to execute:

an operation process for operating, when the engine-driven pump is driven, the switching element by setting a duty cycle of an activation time to a switching cycle, which is a reciprocal of a switching frequency of the switching element, to be a larger value in a case in which a temperature of the internal combustion engine is low than in a case in which the temperature of the internal combustion engine is high; and a cycle varying process for setting the switching cycle to be longer when the temperature of the internal combustion engine is less than a preset temperature than when the temperature of the internal combustion engine is greater than or equal to the preset temperature.

2. The cooling controller according to claim 1, wherein a period longer than the switching cycle set through the cycle varying process when the temperature of the internal combustion engine is less than the preset temperature is referred to as a predetermined period, the switching cycle set through the cycle varying process when the temperature of the internal combustion engine is greater than or equal to the preset temperature is referred to as a first switching cycle, the switching cycle set through the cycle varying process when the temperature of the internal combustion engine is less than the preset temperature is referred to as a second switching cycle, and the duty cycle is set such that a duty cycle that keeps the electromagnetic control valve closed over the predetermined period during the second switching cycle cannot keep the electromagnetic control valve closed over the predetermined period during the first switching cycle.

3. The cooling controller according to claim 1, wherein the cooling device further includes a radiator passage connected to the inner passage, the radiator passage being separate from the outer passage and connected to the radiator, and a thermostat configured to connect and disconnect the inner passage to and from the radiator, the thermostat is configured to allow the inner passage and the radiator to be connected to each other when the temperature of the internal combustion engine is greater than or equal to a predetermined temperature, and the preset temperature is lower than the predetermined temperature.

4. The cooling controller according to claim 1, wherein the operation process includes a process for setting, when the temperature of the internal combustion engine is less than the preset temperature, the duty cycle to be smaller in a case in which a large amount of fuel is supplied into a combustion chamber of the internal combustion engine per unit of time than in a case in which a small amount of fuel is supplied.

5. A control method for a cooling device, the cooling device including an inner passage that circulates coolant in an internal combustion engine, an outer passage located outside the internal combustion engine and connected to the inner passage, the inner passage and the outer passage configuring a loop, an engine-driven pump configured to circulate the coolant in the loop when driven by rotational power of a crankshaft of the internal combustion engine, an electromagnetic control valve configured to adjust a cross-sectional flow area of the outer passage, the electromagnetic control valve being open in a non-energized state when the engine-driven pump is driven, and a driving circuit configured to regulate current flowing through the electromagnetic control valve by activating and deactivating a switching element, wherein the control method comprises:

operating, when the engine-driven pump is driven, the switching element by setting a duty cycle of an activation time to a switching cycle, which is a reciprocal of a switching frequency of the switching element, to be a larger value in a case in which a temperature of the internal combustion engine is low than in a case in which the temperature of the internal combustion engine is high; and setting the switching cycle to be longer when the temperature of the internal combustion engine is less than a preset temperature than when the temperature of the internal combustion engine is greater than or equal to the preset temperature.

* * * * *